United States Patent [19]

Kitai et al.

[11] 4,382,694

[45] May 10, 1983

[54] TIMEPIECE CIRCUIT FOR COMPENSATING TIME LAG JOINED WITH RESET RELEASING

[75] Inventors: Kiyoshi Kitai; Takeo Saito, both of Yotsukaido, Japan

[73] Assignee: Seiko Koki Kabushiki Kaisha, Japan

[21] Appl. No.: 122,173

[22] Filed: Feb. 19, 1980

Related U.S. Application Data

[63] Continuation of Ser. No. 813,767, Jul. 7, 1977, abandoned.

[30] Foreign Application Priority Data

Jul. 9, 1976 [JP] Japan ..... 51-81781

[51] Int. Cl.[3] ..... G04C 9/00

[52] U.S. Cl. ..... 368/187

[58] Field of Search ..... 368/184, 217, 219, 201, 368/85-87, 185-187

[56] References Cited

U.S. PATENT DOCUMENTS 3,754,391 8/1973 Fujita ..... 368/219

4,162,608 7/1979 Morozumi ..... 368/85

*Primary Examiner*—Vit W. Miska

*Attorney, Agent, or Firm*—Robert E. Burns; Emmanuel J. Lobato; Bruce L. Adams

[57] ABSTRACT

A step second timepiece comprises a quartz crystal oscillator and a frequency divider containing a reset circuit. The reset circuit includes a reset switch operable such that the time interval from when the reset switch is released up to when the next pulse is fed from the frequency divider is shorter than the pulse interval of the successive pulses fed from the said frequency divider thereby compensating for time lag associated with the release of the reset switch.

2 Claims, 3 Drawing Figures

TIMEPIECE CIRCUIT FOR COMPENSATING TIME LAG JOINED WITH RESET RELEASING

This is a continuation of application Ser. No. 813,767, filed July 7, 1977 which is now abandoned.

BACKGROUND OF THE INVENTION

The present invention relates to a step-second timepiece comprising a quartz crystal oscillator and a frequency divider containing a reset circuit, and particularly to a circuit for compensating for lags associated with the reset-releasing operation of the reset switch.

The conventional timepiece circuits having a reset circuit generate the driving pulses for operating a step motor just or about one second after the reset-releasing operation.

For a step-second timepiece, the second hand cannot follow instantly but starts several tens of msecs after a driving pulse in output. In addition, when the timepiece is set at standard time by television, radio, telephone or the like, the reset operation is generally released by hand through a reset switch mounted on the timepiece after confirmation of the standard time by means of the operator's ears or eyes. Then because of the hand resetting operation, as a matter of course, a time lag, ordinarily of approximately 100 to 250 msecs, occurs. Accordingly if the reset switch is released after confirmation of setting the standard time, the timepiece will be set inevitably at a slow time because the first driving pulse will occur after the elapse of about one second. This makes it difficult to set exactly the timepiece.

SUMMARY OF THE INVENTION

It is the principal object of the present invention to avoid the disadvantages which have been described hereinbefore, and accordingly to provide a circuit for compensating for the time lag abovementioned in such a way that after releasing of the reset switch, the first driving pulse is delivered at a shorter time interval than the pulse-interval of the successive pulses.

BRIEF DESCRIPTION OF THE DRAWINGS

Other objects, features and advantages of the present invention will appear from the following description of the preferred embodiment with reference to the accompanying drawings in which.

For convenience of description, the frequency of pulses generated by the oscillator is assumed to be 4.194 304 MHz.

DESCRIPTION OF THE PREFERRED EMBODIMENT

Figure 1:
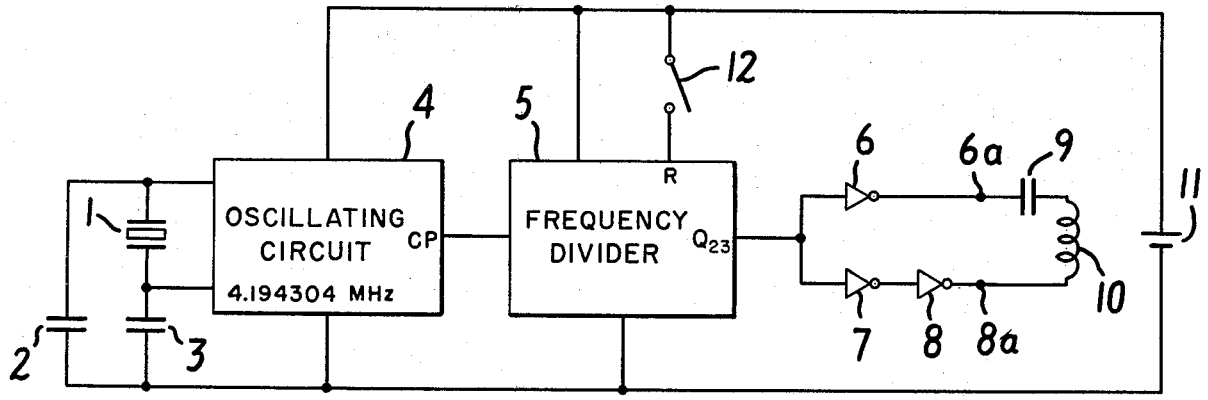
FIG. 1 is a circuit diagram according to the present invention.

In FIG. 1, a quartz crystal of known construction comprises an oscillating circuit 4, and a quartz crystal 1 and condensers 2, 3 connected to the oscillating circuit 4, as illustrated, and the oscillator generates pulses having a frequency of 4.194304 MHz. The oscillator output pulses CP are fed to a frequency divider 5 composed of per se known flip-flop circuits. The pulses CP are frequency-divided in sequence in the frequency divider 5, and the output $Q_{23}$ of the 23rd flip-flop circuit has a frequency of 0.5 Hz. A motor driving circuit consisting of inverters 6, 7, 8 is connected to the output $Q_{23}$ of the frequency divider 5, as illustrated. The respective outputs 6*a* and 8*a* of the inverters 6 and 8 are dependent on the state of $Q_{23}$, and inverse in phase to one another. For instance, when $Q_{23}$ is at a high level, the output 6*a* comes to a high level and the output 8*a* assumes a low level. Hereinafter the high level is referred to as "1" and the low level as "0".

A condenser 9 and a driving coil 10 are connected to the outputs 6*a*, 8*a* of the motor driving circuit and the outputs alternately become "1" or "0" at intervals of one sec causing current to flow in alternate directions through the driving coil 10. Then a step motor of known type (not shown) is caused to be driven by the current to drive a second hand (not shown).

The frequency divider 5 has a reset terminal R connected to the positive terminal of a power supply 11 across a reset switch 12 operable through a reset button (not shown) mounted on the timepiece. The reset switch 12 is normally open in the operating state of the timepiece. When the reset switch 12 is closed for adjusting the second hand, the frequency divider is reset.

Figure 2:
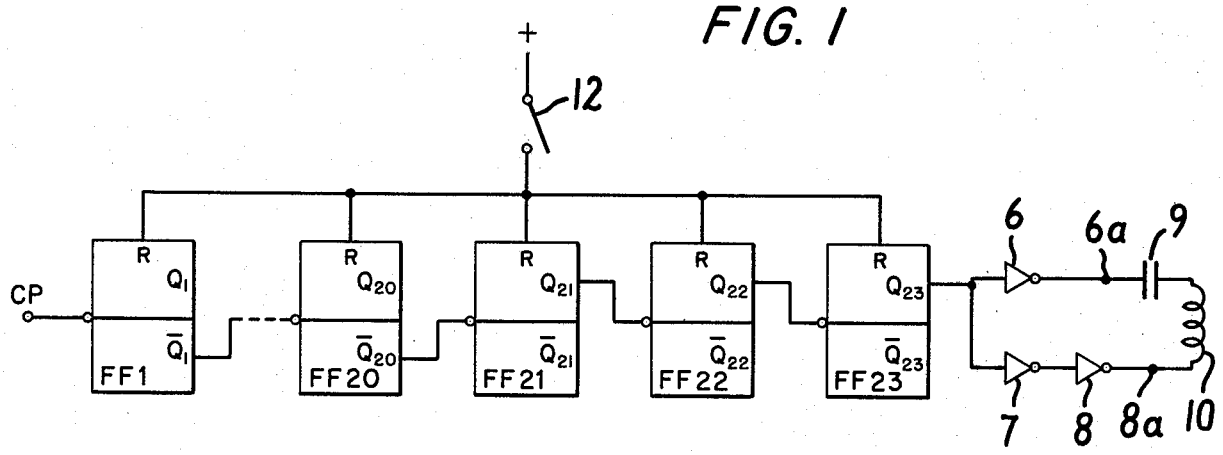
FIG. 2 is a detail representation of the frequency divider illustrated in FIG. 1.

FIG. 2 is a detail representation of the frequency divider 5 illustrated in FIG. 1. The parts corresponding to those in FIG. 1 are referred to by like numerals.

The frequency divider is an array of 23 flip-flop circuits FF1, FF2, . . . , FF23 arranged in cascade connection, as illustrated with partial omission. The respective output signals $\overline{Q}$ of the circuits FF1 to FF20 are fed into the subsequent flip-flop circuits while the circuits FF21 and FF22 feed the respective output signals Q to the subsequent flip-flop circuits. The output signals $\overline{Q}$ and Q are, as known, inverse in phase to one another. If a pulse is applied to the input of any flip-flop circuit, its output $\overline{Q}$ or Q switches in the falling phase of the pulse from "1" to "0" or from "0" to "1".

The first flip-flop circuit FF1 receives the output pulses CP having a frequency of 4.194304 MHz generated by the oscillator 4 as shown in FIG. 1. To the output $Q_{23}$ of the last flip-flop circuit $FF_{23}$ are connected the inverters 6, 7, 8 in the driving circuit as illustrated. The condenser 9 and the driving coil 10 are connected respectively to the outputs of the inverters 6, 8. The respective reset terminals R of the flip-flop circuits of the frequency divider are connected to each other, and to the positive terminal of the power supply 11 through the reset switch 12.

Figure 3:
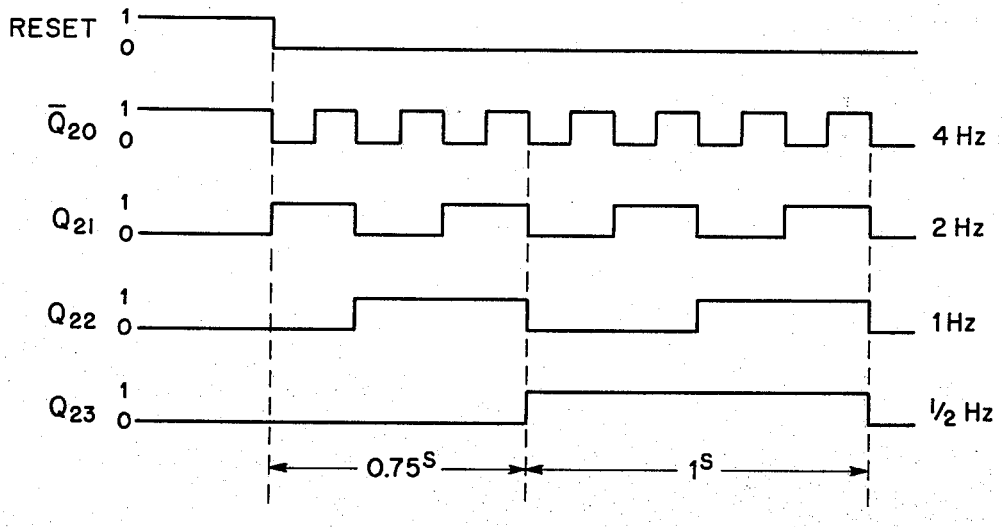
FIG. 3 shows various waveforms at the principal parts of the frequency divider.

Referring to FIG. 3, the mode of operation will now be described. In the operational state of the timepiece, the reset switch 12 is normally open off position, and accordingly the pulses CP having a frequency of 4.194304 MHz generated by the oscillator are applied to the frequency divider. The frequency is divided in sequence by the respective flip-flop circuits. The FF20, FF21, FF22 and FF23 generate output signals having a frequency of 4, 2, 1 and 0.5 Hz respectively. The last output signal $Q_{23}$ is applied to the condenser 9 and the driving coil 10 across the inverter 6 or inverters 7, 8 in the driving circuit, and consequently differentiated current inverting at intervals of one sec flows in the driving coil 10, thereby operating the step motor (not shown).

If the reset switch 12 is closed (referred to as the ON position) in order to set the timepiece, the respective terminals R of the flip-flop circuits in the frequency divider are connected to the positive terminal of the power supply, and the flip-flop circuits are reset. As a result, every $\overline{Q}$ switches to "1" and every Q switches to "0". As the output signal $Q_{23}$ is then "0", the output 6a of the driving circuit is held at "1" while the output 8a is held at "0". Consequently no current flows through the driving coil.

When the reset switch 12 is then opened for setting at a desired time by television, radio or the like, the first pulse having a frequency of 4.194304 MHz generated by the oscillator is fed into the first flip-flop circuit FF1 and its output signal $Q_1$ switches from "1" to "0", and $Q_2$ of FF2 to $Q_{20}$ of FF20 switch in likewise fashion. Then the output $Q_{21}$ of FF21, the output $Q_{22}$ of FF22 and 0.75 secs after the opening of the reset switch 12, the output $Q_{23}$ of FF23 in turn switch from "0" to "1", as shown in FIG. 3. In consequence the output 6a of the driving circuit 10 comes "0", and current flows from 8a to 6a across the driving coil 10 and the condenser 9 to start the step motor whereupon the second hand is driven a second ahead.

There is a time lag from when the operator confirms that the time being set has reached the desired time up to when the operator opens the reset switch and another time lag from the instant when current flows through the driving coil up to when the second hand is driven, and the sum of these two time lags is assumed to be 0.25 secs. To this time lag period, add the period from when the reset switch is opened up to when $Q_{23}$ inverts, which is assumed to be 0.75 secs, and the total is 1 sec. In this way, it is possible to set the timepiece exactly at a standard time.

One sec later, $Q_{23}$ switches again to "0", and current flows from 6a to 8a across the condenser 9 and the driving coil 10. Then the second hand is driven one sec ahead.

It is not always necessary, as in this embodiment, that all the flip-flop circuits of the frequency divider be reset when the reset switch 12 is closed, but it may be that merely a sufficient number of the flip-flop circuits be reset within a range of not very great error. For example, the error introduced is at most 7 or 8 msecs when the 16th flip-flop circuit and all the following are reset.

FIG. 3 shows the reset terminals in FIG. 2 and the wave forms of the signals $Q_{20}$, $Q_{21}$, $Q_{22}$ and $Q_{23}$.

Correction against the time lags associated with the reset releasing need not be limited to the value taken in this embodiment, 250 msecs, but can be varied depending upon the construction of circuit. Also the circuit is not limited to this embodiment.

As understood from the abovementioned, the important advantage of the present invention is to enable the extremely exact setting of an electronic timepiece at a standard time by compensating with a circuit the time lags inherently associated with the reset releasing operation of the reset switch.

What is claimed is:

1. In a step-second timepiece: oscillating means for producing a high frequency signal suitable as a time standard; resettable multi-stage frequency-dividing means connected to said oscillating means to receive therefrom the high frequency signal for frequency dividing the high frequency signal into a low frequency time signal comprised of a succession of low frequency pulses, said resettable multi-stage frequency-dividing means comprising a series of frequency-dividing stages connected in cascade such that the output signals of successive stages are in phase except for the output signals of at least the last three stages which are of opposite phase; motor driving means connected to the last one of the frequency-dividing stages to receive therefrom the low frequency signal for applying the low frequency pulses as drive pulses to a motor; and means including a manually actuatable reset switch for setting time and connected to said resettable multi-stage frequency-dividing means for resetting said frequency-dividing means such that the time interval from when said reset switch is released up to when the first low frequency pulse is output by said frequency-dividing means is shorter than the pulse interval of the successive low frequency pulses produced by said frequency-dividing means thereby effectively compensating for the time lag inherently associated with the release of said reset switch.

2. A step-second timepiece according to claim 1; wherein said series of frequency-dividing stages comprises a series of resettable flip-flop circuits connected in cascade with the reset terminals of the flip-flop circuits being connected to said reset switch.

* * * * *